US008136430B2

(12) United States Patent
Hu

(10) Patent No.: US 8,136,430 B2
(45) Date of Patent: Mar. 20, 2012

(54) RETRACTABLE SCREWDRIVER

(76) Inventor: Chung-Te Hu, Tainan Hsien (TW)

( * ) Notice: Subject to any disclaimer, the term of this patent is extended or adjusted under 35 U.S.C. 154(b) by 343 days.

(21) Appl. No.: 12/574,781

(22) Filed: Oct. 7, 2009

(65) Prior Publication Data

US 2011/0079116 A1 Apr. 7, 2011

(51) Int. Cl.
*B25B 23/16* (2006.01)

(52) U.S. Cl. ..... 81/177.2; 81/439

(58) Field of Classification Search ..... 81/177.2, 81/438, 439

See application file for complete search history.

(56) References Cited

U.S. PATENT DOCUMENTS 4,409,866 A * 10/1983 McBride ..... 81/177.2
4,581,961 A * 4/1986 Lai ..... 81/439
6,155,144 A * 12/2000 Lin ..... 81/438
7,878,094 B2 * 2/2011 Lin ..... 81/177.2
2004/0020331 A1 * 2/2004 Lee ..... 81/177.2
2011/0083536 A1 * 4/2011 Palmisano ..... 81/439

* cited by examiner

*Primary Examiner* — Debra S Meislin
(74) *Attorney, Agent, or Firm* — Rosenberg, Klein & Lee

(57) ABSTRACT

A retractable screwdriver includes a handle, a positioning member, an operation ring, a shank, a sleeve and a drive socket. The positioning member includes a first opening and a second opening respectively defined through a wall thereof and communicating with the passage. The length of the first opening is shorter than that of the second opening. A first wall is formed at the first opening and a second wall is formed at the second opening. The first and second walls are located on different radial planes and have a distance defined therebetween in a radial direction. The opening ring is obliquely located in the passage and biased by the second spring to keep an inclination of the operation ring. The operation ring has its contact edge to contact the shank so as to achieve the purpose of adjustment of the shank.

5 Claims, 7 Drawing Sheets

RETRACTABLE SCREWDRIVER

FIELD OF THE INVENTION

The present invention relates to a screwdriver, and more particularly, to a screwdriver having a retractable shank which does not move when operation.

BACKGROUND OF THE INVENTION

A conventional screwdriver is used for general mechanical assembling purposes such as tightening or loosening bolts. The requirement of the length of the shank of the screwdriver varies in different needs so that an extension rod is usually used so as to extend the bit to a deeper position. However, it is inconvenient for the users to carry extension rods in different lengths.

Taiwan Utility Model Publication No. M254310 discloses a retractable shank for a ratchet tool, which includes a handle with a ratchet unit received in an end of the handle and a retractable shank unit is connected with the ratchet unit. A ratchet device is connected to the ratchet unit and the shank is engaged with the ratchet device so as to rotate by the ratchet device. The shank includes an inner rod and an outer rod which accommodates the inner rod. The outer rod includes threads defined in an outer periphery of a first end thereof and is engaged with the ratchet device. The outer rod further includes two slots in a second end thereof and the inner rod has a first end thereof connected with a locking member and a second end of the inner rod is inserted into the handle. A groove is defined in an outer periphery of the second end of the inner rod. A control unit is located at the outer periphery of the shank and includes an operation member movably engaged with the two slots. A resilient member and a spring are mounted to the outer rod and a sleeve is mounted to the parts mentioned above. The operation member includes a boss at an inner periphery thereof and the boss is engaged with the groove. The operation member includes two protrusions protruding from the outer periphery thereof so as to be engaged with the slots. The resilient member and spring contact the operation member so as to control and restrict the axial movement of the shank such that the inner rod can only move axially relative to the outer rod, and cannot rotate relative to the outer rod. The inner rod connected with the locking member is retractable when using the ratchet tool. The conventional ratchet tool uses the inclination of the operation member whose inner edge contacts against the inner rod to prevent the inner rod from being retracted. The protrusions are restricted within the groove of the inner rod to prevent the inner rod from rotating during use. However, the operation member is a ring-shaped member which might be deformed when a significant torque is applied to the operation member. The protrusions can also slide off from the grooves during use and the inner rod cannot output torque to tighten bolts. The inner edge of the operation member contacts the inner rods at two points which cannot bear large torque and the operation member is therefore deformed. Besides, there are too many parts in the conventional screwdriver and may need extra maintenance.

SUMMARY OF THE INVENTION

According to the present invention, there is provided a retractable screwdriver comprising a handle having a recess defined in an end thereof; a positioning member fixed in the recess of the handle, an insertion section extending from the positioning member, a passage defined in the positioning member and shaped to match with a cross section of a shank, a flange formed at a conjunction of the positioning member and the insertion section, a first spring mounted to the insertion section, a first opening and a second opening respectively defined through a wall of the positioning member and communicating with the passage, a length of the first opening being shorter than that of the second opening, a first wall formed at the first opening and a second wall formed at the second opening, the first and second walls located on different radial planes and having a distance defined therebetween in a radial direction, a second spring received in the passage, the shank having at least one surface and at least one ridge; an operation ring obliquely located in the passage and biased by the second spring to keep an inclination of the operation ring, the operation ring having a through hole through which the shank extends, a contact edge defined by an inner periphery of the through hole, the contact edge contacting the surface of the shank, the contact edge being formed with two opposite notches to engage with the ridge of the shank, a first contact portion and a second contact portion formed on two ends of the operation ring, the first contact portion being inserted into the first opening of the positioning member and contacting the first wall, the second contact portion being inserted into the second opening of the positioning member; a sleeve mounted to the positioning member, the sleeve including a mounting hole therein, a protrusion extending inward from an inner periphery thereof, and a push portion formed in the inner periphery of the sleeve, and a drive socket mounted to the shank.

Preferably, the shank has a first end and a second end, the second end being formed with a groove and a clip being provided in the groove.

Preferably, the drive socket has a first reception hole and a second reception hole defined in two ends thereof, the first end of the shank is inserted into the first reception hole and a bit is inserted into the second reception hole.

Preferably, the first spring has a first end and a second end, the first end of the first spring contacting the flange of the positioning member, the second end of the first spring contacting the protrusion of the sleeve.

Preferably, the shank has six adjacent surfaces and six ridges each formed between every two of the surfaces.

The present invention includes the following advantages:

1. The shank of the present invention can be adjusted to a desired length and the screwdriver is easily operated without much maintenance. The shank is well positioned during operation.

2. The operation member is a plate which includes first and second contact portions with certain thickness and width. The operation member is cooperated with the springs to restrict the movement of the shank.

3. The passage of the positioning member contacts the shank at least one surface and ridge so that the operation ring won't be deformed and has a longer life of use.

The present invention will become more obvious from the following description when taken in connection with the accompanying drawings which show, for purpose of illustration only, a preferred embodiment in accordance with the present invention.

DETAILED DESCRIPTION OF THE PREFERRED EMBODIMENT

Figure 1:
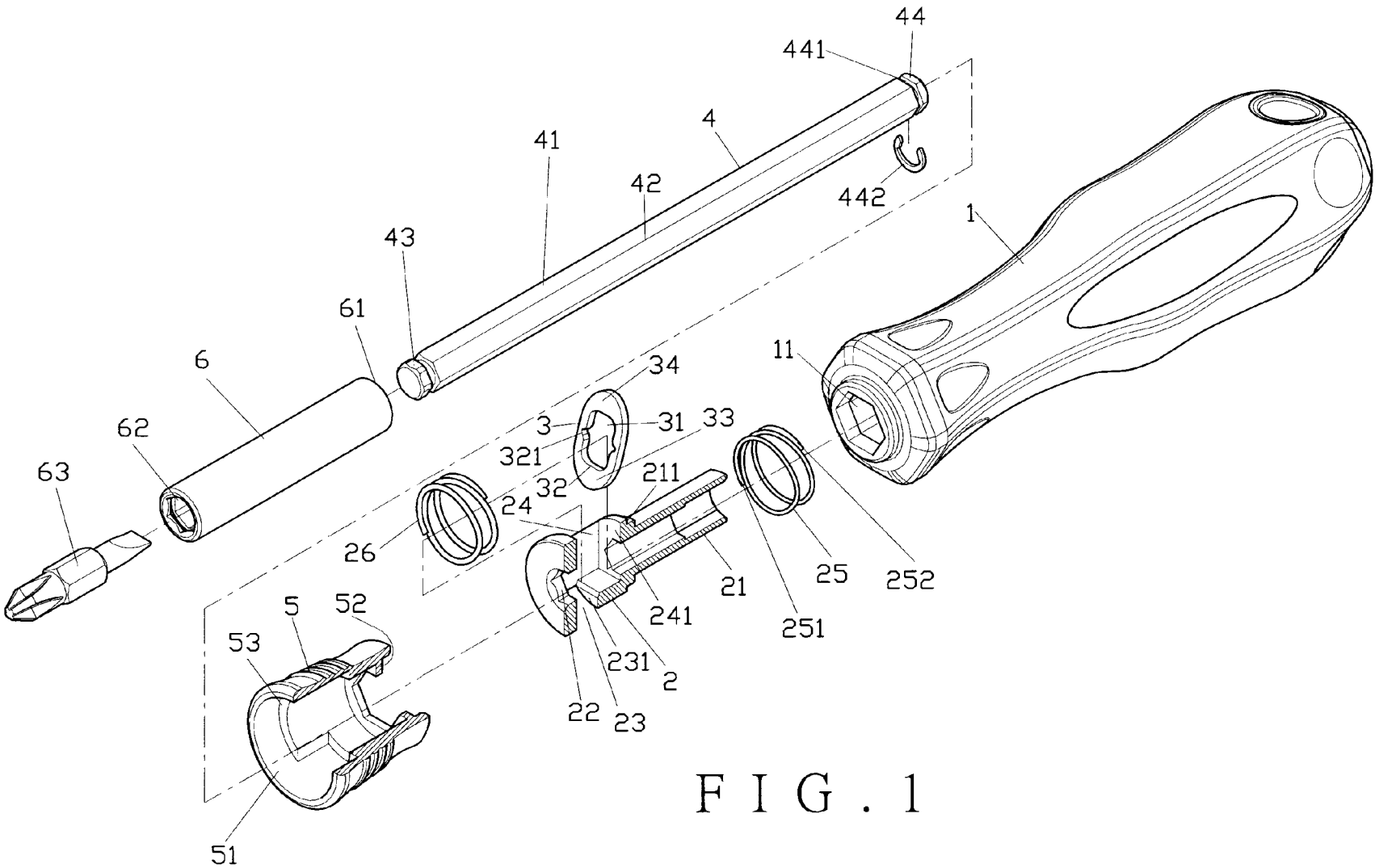
FIG. 1 is an exploded view of the present invention.
Figure 2:
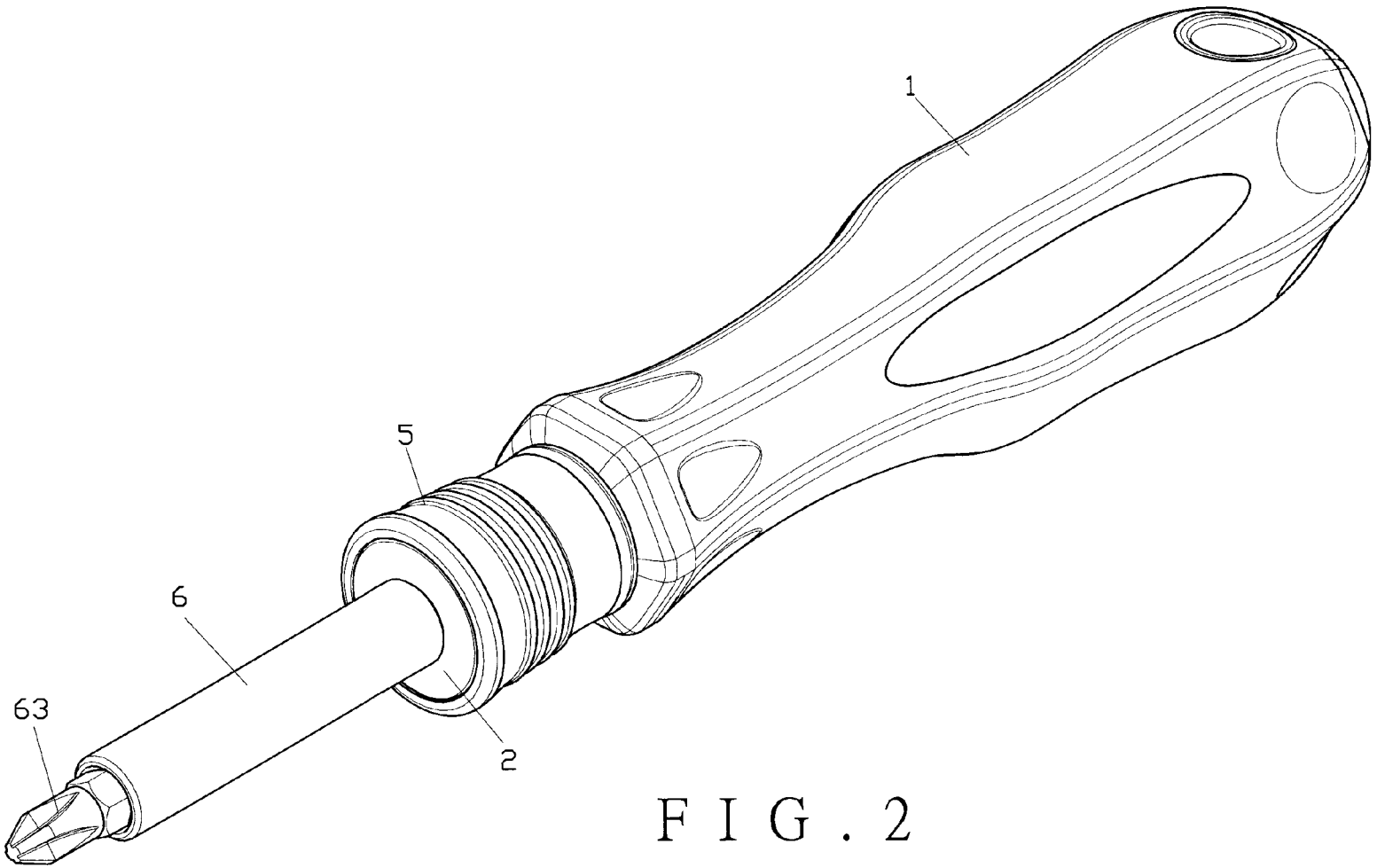
FIG. 2 is a perspective view of the present invention.

Referring to FIGS. 1 and 2, the retractable screwdriver of the present invention comprises a handle 1, a positioning member 2, an operation ring 3, a shank 4, a sleeve 5 and a drive socket 6.

Figure 3:
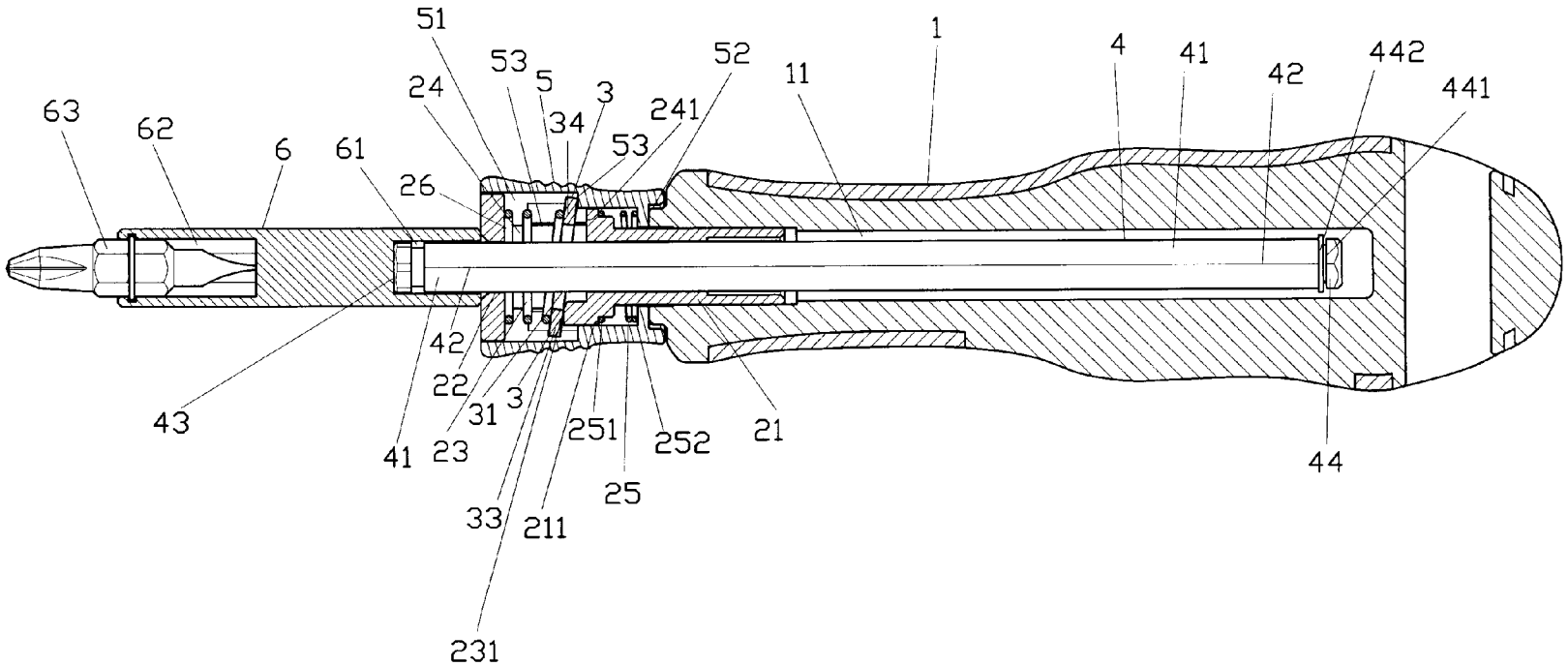
FIG. 3 is a cross sectional view of the present invention.

The handle 1 includes a recess 11 defined in an end thereof as shown in FIG. 3.

Figure 4:
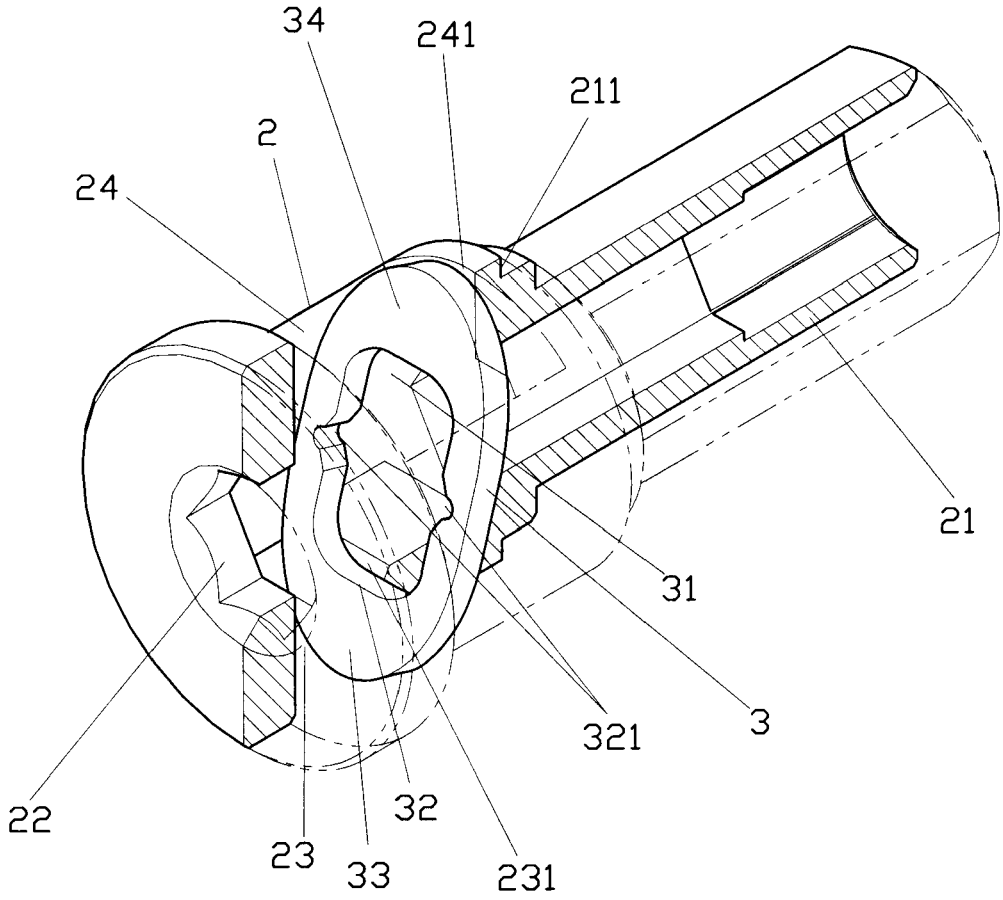
FIG. 4 is a schematic view showing assembly of an operation ring and a positioning member of the present invention.
Figure 5:
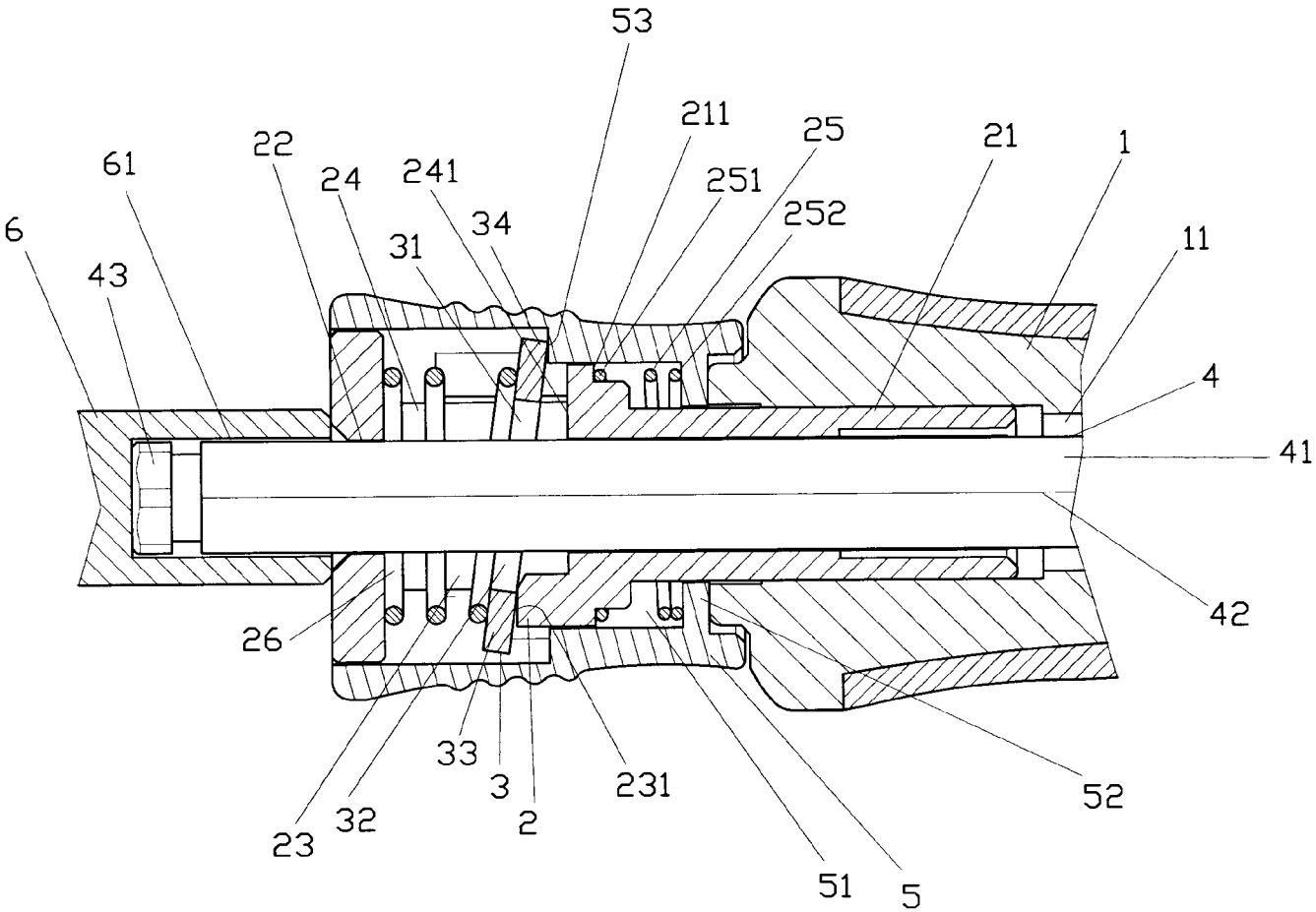
FIG. 5 is a cross sectional view showing that the operation ring is biased by the second spring and contacts the shank of the present invention.

The positioning member 2 is fixed in the recess 11 of the handle 1 as shown in FIGS. 4 and 5, and an insertion section 21 extends from the positioning member 2 so as to be inserted into the recess 11. A flange 211 is formed at a conjunction of the positioning member 2 and the insertion section 21. A passage 22 is defined in the positioning member 2 and shaped to match with a cross section of the shank 4. A first opening 23 and a second opening 24 are respectively defined through a wall of the positioning member 2 and communicate with the passage 22. The length of the first opening 23 is shorter than that of the second opening 24. A first wall 231 is formed at the first opening 23 and a second wall 241 is formed at the second opening 24. The first and second walls 231, 241 are located on different radial planes and have a distance defined therebetween in a radial direction. A first spring 25 is fitted on the insertion section 21. The first spring 25 has a first end 251 and a second end 252. The first end 251 of the first spring 25 is against the flange 211 of the positioning member 2. A second spring 26 is received in the passage 22 via the first opening 23 or the second opening 24.

The operation ring 3 is obliquely located in the passage 22 of the positioning member 2 and biased by the second spring 26 to keep an inclination of the operation ring 3. The operation ring 3 is an oval plate and has a through hole 31 through which the shank 4 extends. A contact edge 32 is defined by an inner periphery of the through hole 31. The contact edge 32 is formed with two opposite notches 321. A first contact portion 33 and a second contact portion 34 are formed on two ends of the operation ring 3. The first contact portion 33 is inserted into the first opening 23 of the positioning member 2 and leans against the first wall 213, and the second contact portion 34 is inserted into the second opening 24 of the positioning member 2.

The shank 4 is inserted in the passage 22 of the positioning member 2, the through hole 31 of the operation ring 3 and the second spring 26. The shank 4 has six adjacent surfaces 41 and six ridges 42 each formed between every two of the surfaces 41. The contact edge 32 of the operation ring 3 contacts one of the surfaces 41. The operation ring 3 is biased by the second spring 26 and the first contact portion 33 leans against the first wall 231 so that the contact edge 32 contacts two of the surfaces 41 to restrict movement of the shank 4 relative to the operation ring 3. The passage 22 of the positioning member 2 is shaped to match with the shank 4 so that the shank 4 is not rotated relative to the passage 22 and the through hole 31. When the operation ring 3 is positioned to be perpendicular to the shank 4, the shank 4 can be moved axially relative to the operation ring 3. The shank 4 has a first end 43 and a second end 44. The second end 44 is formed with a groove 441 and a clip 442 is provided in the groove 441, so that the second end 44 of the shank 4 does not be disengaged from the insertion section 21 of the positioning member 2.

The sleeve 5 is mounted to the positioning member 2 and has a mounting hole 51 to accommodate the operation ring 3. A protrusion 52 extends inward from an inner periphery of the sleeve 5 such that the second end 252 of the first spring 25 is against the protrusion 52. A push portion 53 is formed in the inner periphery of the sleeve 5 so as to contact the second contact portion 34 of the operation ring 3.

The drive socket 6 is mounted to the first end 43 of the shank 4 and has a first reception hole 61 and a second reception hole 62 defined in two ends thereof. The first end 43 of the shank 4 is inserted in the first reception hole 61 and a bit 63 is inserted in the second reception hole 63.

Figure 6:
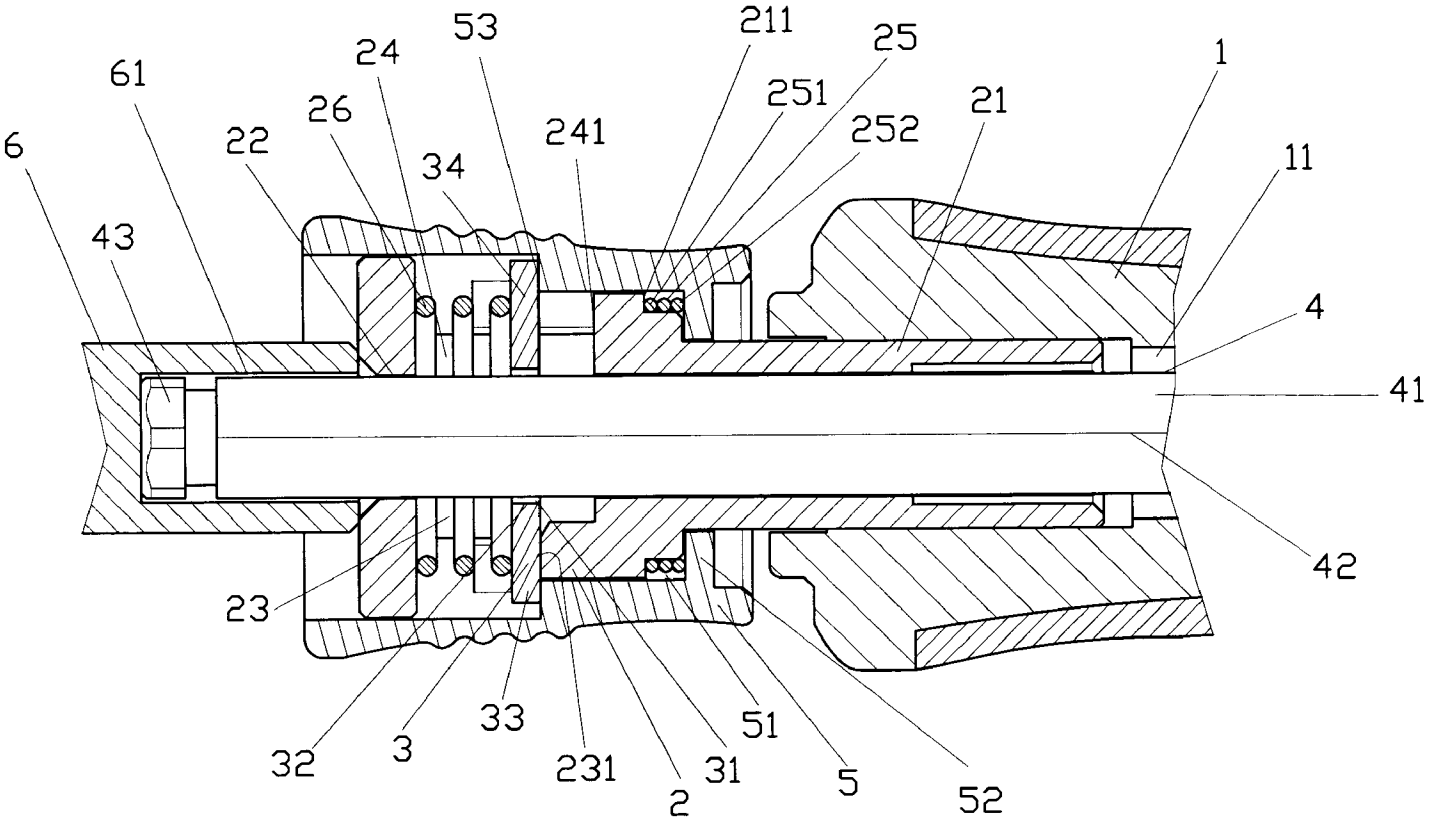
FIG. 6 is a cross sectional view showing that the operation ring is pushed and the shank is freely movable relative to the operation ring of the present invention.
Figure 7:
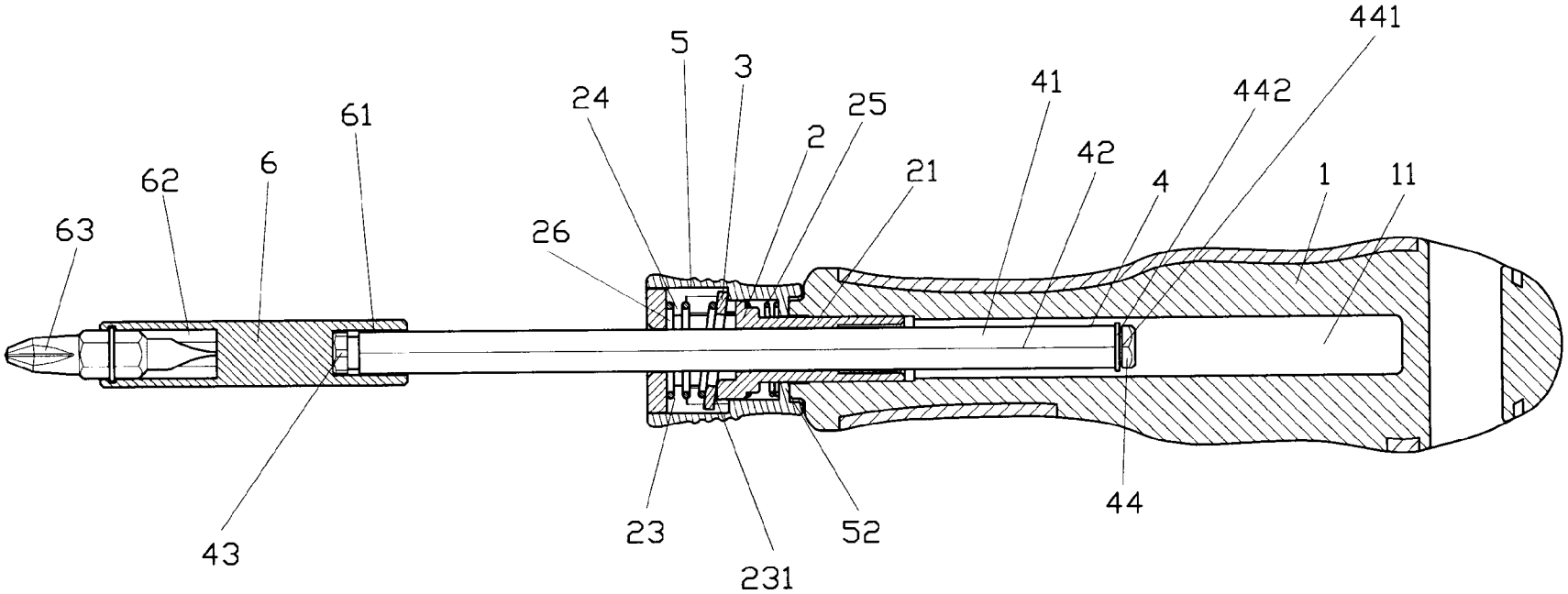
FIG. 7 is a cross sectional view showing that the shank is extended from the handle of the present invention.

As shown in FIGS. 6 and 7, when adjusting the length of the shank 4 out of the handle 1 of the screwdriver, simply pulling the shank 4 outward which drives the operation ring 3 to compress the second spring 26 and the operation ring 3 is perpendicular to the shank 4 which is then freely movable relative to the operation ring 3. When the shank 4 is moved to a desired position, the shank 4 is released and the second spring 26 pushes the operation ring 3 to set the operation ring 3 to be inclined so as to lock the shank 4. When retracting the shank 4, the sleeve 5 is pulled toward the drive socket 6 and the protrusion 52 compresses the second end 252 of the first spring 25. When moving the sleeve 5, the push portion 53 contacts the second contact portion 34 of the operation ring 3 and moves the second contact portion 34 toward the second opening 26. The first and second contact portions 33, 34 of the operation ring 3 move in the first and second openings 23, 24 respectively to compress the second spring 26 until the push portion 53 in parallel contacts the first and second contact portions 33, 34. Because the contact edge 32 of the operation ring 3 does not contact the surfaces 41 of the shank 4, the shank 4 is movable in the passage 22 of the positioning member 2. When the shank 4 is moved to a desired position, the sleeve 5 is released and the first spring 25 moves the sleeve 5 back to its original position as shown in FIGS. 3 and 5. The force of the second spring 26 keeps the operation ring 3 in an inclined status in the passage 22. The contact edge 32 of the operation ring 3 contacts the surfaces 41 of the shank 4 again. Because the first contact portion 33 is biased by the first wall 231, which forms a leverage function to let the contact edge 32 firmly contact the surfaces 41 of the shank 4. The contact area between the contact edge 32 and the surfaces 41 of the shank 4 are two surfaces so as to securely lock the shank 4 which does not move relative to the operation ring 3. When a torque applied to the bit 63, the shank 4 does not move relative to the operation ring 3 which is protected from being deformed. The passage 22 is shaped to match with the cross section of the shank 4 so that the shank 4 does not rotate relative to the operation ring 3 even when a significant torque is applied to the shank 4.

While we have shown and described the embodiment in accordance with the present invention, it should be clear to those skilled in the art that further embodiments may be made without departing from the scope of the present invention.

What is claimed is:

1. A retractable screwdriver, comprising:

a handle having a recess defined in an end thereof;

a positioning member fixed in the recess of the handle, an insertion section extending from the positioning member, a passage defined in the positioning member and shaped to match with a cross section of a shank, a flange formed at a conjunction of the positioning member and the insertion section, a first spring mounted to the insertion section, a first opening and a second opening respectively defined through a wall of the positioning member and communicating with the passage, a length of the first opening being shorter than that of the second opening, a first wall formed at the first opening and a second wall formed at the second opening, the first and second walls located on different radial planes and having a distance defined therebetween in a radial direction, a second spring received in the passage, the shank having at least one surface and at least one ridge;

an operation ring obliquely located in the passage and biased by the second spring to keep an inclination of the operation ring, the operation ring having a through hole through which the shank extends, a contact edge defined by an inner periphery of the through hole, the contact edge contacting the surface of the shank, the contact edge being formed with two opposite notches to engage with the ridge of the shank, a first contact portion and a second contact portion formed on two ends of the operation ring, the first contact portion being inserted into the first opening of the positioning member and contacting the first wall, the second contact portion being inserted into the second opening of the positioning member;

a sleeve mounted to the positioning member, the sleeve including a mounting hole therein, a protrusion extending inward from an inner periphery thereof, and a push portion formed in the inner periphery of the sleeve, and a drive socket mounted to the shank.

2. The screwdriver as claimed in claim 1, wherein the shank has a first end and a second end, the second end being formed with a groove and a clip being provided in the groove.

3. The screwdriver as claimed in claim 2, wherein the drive socket has a first reception hole and a second reception hole defined in two ends thereof, the first end of the shank is inserted into the first reception hole and a bit is inserted into the second reception hole.

4. The screwdriver as claimed in claim 1, wherein the first spring has a first end and a second end, the first end of the first spring contacting the flange of the positioning member, the second end of the first spring contacting the protrusion of the sleeve.

5. The screwdriver as claimed in claim 1, wherein the shank has six adjacent surfaces and six ridges each formed between every two of the surfaces.

* * * * *